US007451944B2

(12) United States Patent
Hall et al.

(10) Patent No.: US 7,451,944 B2
(45) Date of Patent: Nov. 18, 2008

(54) REPLACEABLE SEGMENTED WEAR LINER

(76) Inventors: David R. Hall, 2185 S. Larsen Pkwy., Provo, UT (US) 84606; Ronald B. Crockett, 2185 S. Larsen Pkwy., Provo, UT (US) 84606; Jeff Jepson, 2185 S. Larsen Pkwy., Provo, UT (US) 84606; John Bailey, 2185 S. Larsen Pkwy., Provo, UT (US) 84606

( * ) Notice: Subject to any disclaimer, the term of this patent is extended or adjusted under 35 U.S.C. 154(b) by 109 days.

(21) Appl. No.: 11/668,407

(22) Filed: Jan. 29, 2007

(65) Prior Publication Data

US 2008/0041995 A1 Feb. 21, 2008

Related U.S. Application Data

(63) Continuation-in-part of application No. 11/426,202, filed on Jun. 23, 2006, now abandoned.

(51) Int. Cl.
*B02C 2/00* (2006.01)

(52) U.S. Cl. ..... 241/207; 241/294; 241/300

(58) Field of Classification Search ..... 241/261.1, 241/207–216, 300, 294
See application file for complete search history.

(56) References Cited

U.S. PATENT DOCUMENTS

| | | | | |
|---|---|---|---|---|
| 3,834,633 | A | 9/1974 | Dougall | |
| 4,010,905 | A | 3/1977 | Motz | |
| 4,886,218 | A * | 12/1989 | Bradley et al. | 241/294 |
| 5,080,294 | A * | 1/1992 | Dean | 241/294 |
| 5,967,431 | A | 10/1999 | Stafford | |
| 6,123,279 | A | 9/2000 | Stafford | |

* cited by examiner

*Primary Examiner*—Mark Rosenbaum
(74) *Attorney, Agent, or Firm*—Tyson J. Wilde

(57) ABSTRACT

In one aspect of the invention, a cone crusher comprises a crushing surface comprising a conical head and a concave bowl. At least one of the head or bowl comprises a segmented wear liner wherein at least one segment of the wear liner is held in place by compression.

17 Claims, 12 Drawing Sheets

REPLACEABLE SEGMENTED WEAR LINER

CROSS REFERENCES

This Patent Application is a continuation in-part of U.S. patent application Ser. No. 11/426,202 filed on Jun. 23, 2006 now abandoned and entitled A Replaceable Wear liner with Super Hard Composite Inserts, which is herein incorporated by reference in its entirety.

BACKGROUND OF THE INVENTION

Replaceable wear liners are often incorporated into cone crushers to form the crushing surfaces used to crush various materials. Cone crushers typically comprise an eccentric assembly that rotates about a stationary shaft resulting in a gyratory motion which is harnessed to crush material as it traverses between crushing surfaces in the crushing chamber where the replaceable wear liners are located. Material to be crushed is effectively reduced into smaller dimensions as a result of being subjected to compression between the tapered crushing surfaces of the crushing chamber. The reduced material then exits from a gap between the crushing surfaces sometimes called the "closed side setting" where the minimum width of the reduced material is predetermined by manipulating the closed side setting in accordance with the desired geometry of the reduced material. The final product consists of material that possesses the desired geometry or ratio of length to width to thickness. Various applications such as road surfacing, paving, landscaping and so forth have various desired geometries.

Over time the replaceable wear liner may begin to deteriorate such that the space between the crushing surfaces becomes distorted, which consequently reduces the crusher's ability to produce the desired geometry. This results in irregular or substandard final product material. Substandard product may require that the replaceable wear liner be serviced or replaced. Consequently, the time required to properly address wear issues equates to significant economic loss both in terms of maintenance and production loss.

In the prior art, U.S. Pat. No. 5,967,431 by Stafford, et al., which is herein incorporated by reference for all that it contains, discloses a rock crusher such as a cone or jaw crusher that incorporates hardened tapered inserts in the manganese or other wear liner of at least one of its crushing elements. The inserts extend outwardly from the crushing surface of the crushing element towards the facing crushing surface so as, in use, to act as pick axes that shatter rock primarily by impact rather than pulverizing the rock by compression.

U.S. Pat. No. 6,123,279 by Stafford, et al., which is herein incorporated by reference for all that it contains, discloses a rock crusher such as a cone or jaw crusher that incorporates hardened tapered inserts in the manganese or other wear liner of at least one of its crushing elements.

U.S. Pat. No. 4,010,905 by Motz et al., which is herein incorporated by reference for all that it contains, discloses a liner segment which, when grouped with a plurality of like segments, is usable as a composite wearing element for lining the bowl in a cone crusher or the like.

U.S. Pat. No. 3,834,633 by Dougall et al., which is herein incorporated by reference for all that it contains, discloses liner assemblies for the bowl and mantel of a gyratory cone crushing machine. Each assembly includes a liner backing plate formed from a material of low abrasion resistance which takes the form of a truncated cone to conform to the associated bowl or mantle. The crushing surface of the liner assembly is defined by a plurality of arcuate segments. The segments are arranged in a ring fashion on the backing plate and secured thereto with a resilient adhesive such as urethane.

BRIEF SUMMARY OF THE INVENTION

A cone crusher comprises a crushing surface comprising a conical head and a concave bowl. At least one of the head or bowl comprises a segmented wear liner wherein at least one segment of the wear liner is held in place by compression. A body of the wear liner may comprise manganese, steel, stainless steel, carbide, tungsten carbide, hard metal, chromium, aluminum, nitride, titanium, or combinations thereof. The wear liner may comprise a hard surface of a material selected from the group consisting of tungsten carbide, niobium carbide, a cemented metal carbide, hard metal, chromium, aluminum, nitride, titanium manganese carbide, or combinations thereof.

Adjacent segments of the wear liner may interlock with one another. Segments of the wear liner may interlock with at least one of the head or the bowl. In some embodiments of the invention the bowl and/or the cone may comprise a guide track or a plurality of guide tracks. The interlocking segments, and/or at least one segment and at least one of the cone or the bowl, may form a joint from the group consisting of tongue and groove joint, mortise and tenon joint, lap-joint, dovetail joint, or combinations thereof. The segments of the wear liner may be held in place by lateral compression In some embodiments of the invention the segments may be held in place by axial compression. The segments of the liner may be adapted to wedge together. The wear liner may be vertically segmented, horizontally segmented, or both. A junction between adjacent segments may be planar or non-planar. In some embodiments of the invention two vertically adjacent segments may be offset.

In some embodiments of the invention the wear liner may comprise a plurality of wear resistant inserts. The wear resistant inserts may comprises a coating selected from the group consisting of diamond, polycrystalline diamond, cubic boron nitride, refractory metal bonded diamond, silicon bonded diamond, cobalt bonded diamond, layered diamond, infiltrated diamond, thermally stable diamond, natural diamond, vapor deposited diamond, physically deposited diamond, diamond impregnated matrix, diamond impregnated carbide, cemented metal carbide, carbide matrix, chromium, titanium, aluminum, tungsten, and combinations thereof. The inserts may be brazed or press fit into cavities in the crushing surface. The inserts may protrude beyond the crushing surface by 0.010 to 3.00 inches. The inserts may have a circumscribing wear resistant washer. In some embodiments of the invention the wear liner may comprise at least one insert comprising a wear resistant washer that is separated from the insert by a material that is softer than both the insert and the washer.

In one aspect of the present invention, a method of assembling a segmented wear resistant liner for a cone crusher comprises the steps of sliding a segment into position beginning at the bottom and moving towards the top and fastening a base piece below the segment to hold it in place by compression.

DETAILED DESCRIPTION OF THE INVENTION AND THE PREFERRED EMBODIMENT

Figure 1:
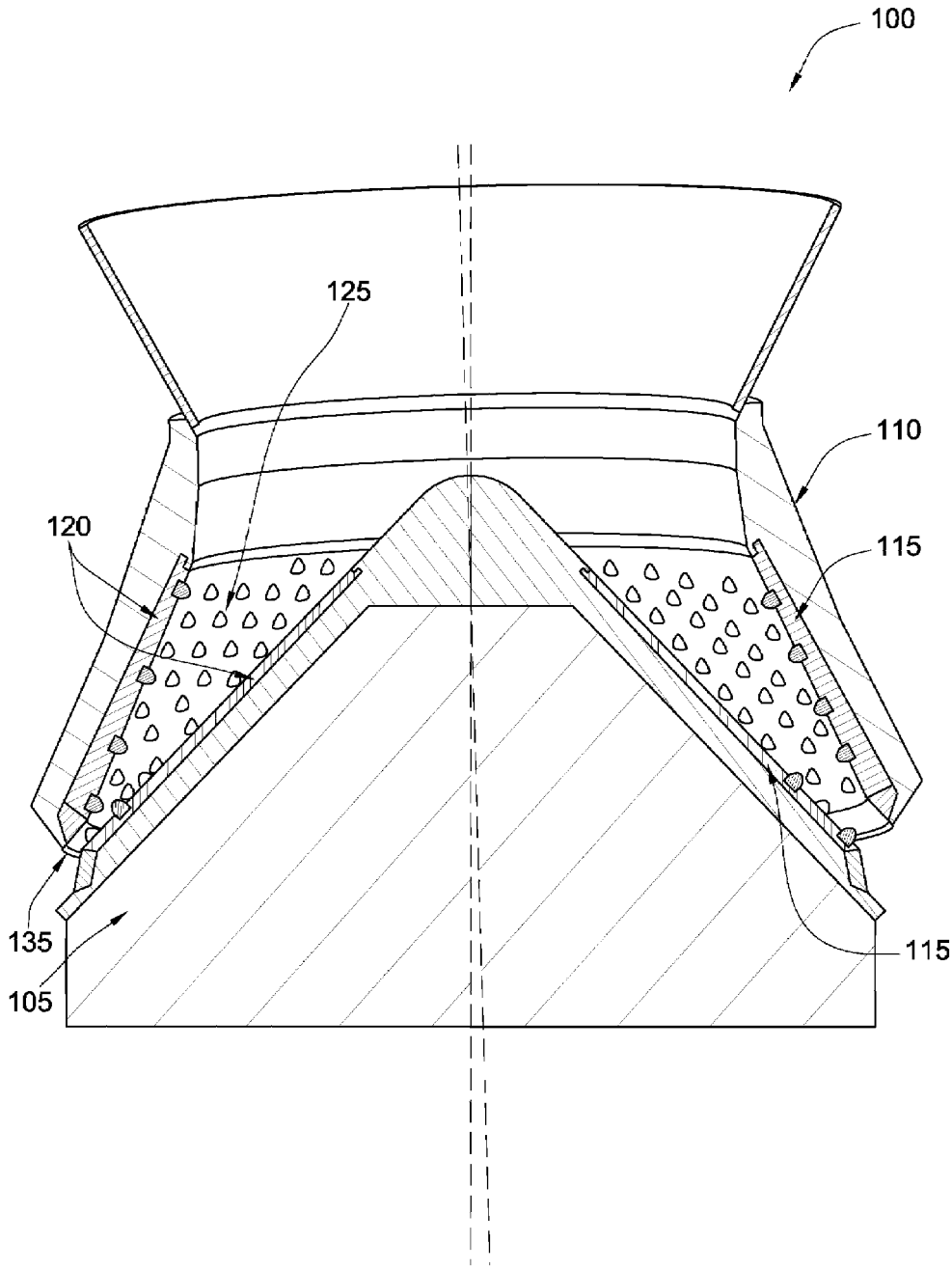
FIG. 1 is a cross-sectional diagram of an embodiment of a cone crusher.

FIG. 1 depicts an embodiment of a cone crusher 100 in accordance with the present invention. The cone crusher comprises a concave bowl 110 and a conical head 105. Exposed surfaces of the conical head and concave bowl form crushing surfaces 120 in a crushing chamber 125. The concave bowl 110 is typically connected to a hopper (not shown) for receiving material to be crushed, typically rock. Rock may enter the crushing chamber 125 through an open end of the bowl 110. Once in the crushing chamber 125, the rock comes into abrasive contact with the crushing surfaces 120, generally through movement of the head 105 and/or the bow 110. The crushing surfaces 120 may be tapered such that the width of the crushing chamber 125 decreases further down the head 105 and the bowl 110. This reduced width may cause increased abrasion of the material being crushed by the crushing surfaces 120 thus reducing the size of the material. The reduced material may then exit through a gap 135 between the crushing surfaces sometimes called the "closed side setting" where the minimum width of the reduced material is predetermined by manipulating the width of the gap in accordance with the desired size of the reduced material. The cone crusher 100 may comprise at least one replaceable segmented wear liner 115 configured for either a conical head 105 or a concave bowl 110. The conical head 105 and concave bowl 110 may each comprise replaceable segmented wear liners 115, the body of which may comprise manganese, steel, stainless steel, carbide, tungsten carbide, hard metal, chromium, aluminum, nitride, titanium, or combinations thereof. In one aspect of the invention, the segmented wear liner 115 is held in place by compression.

Figure 2:
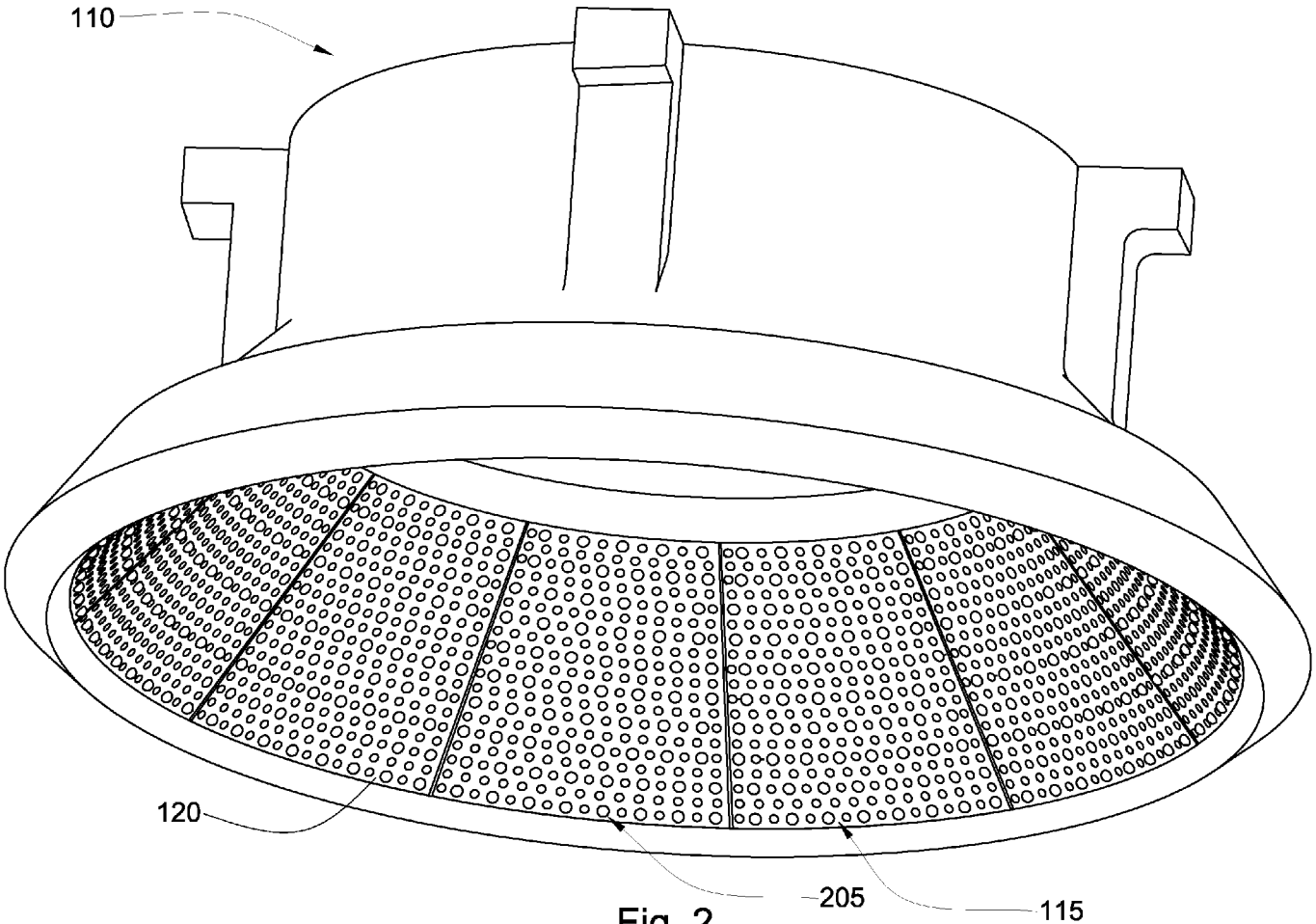
FIG. 2 is a perspective diagram of an embodiment of a replaceable segmented wear liner.

Referring now to FIG. 2, an embodiment of a segmented wear liner is disposed on the crushing surface 120 of a concave bowl 110. The diagram discloses super hard composite inserts 205 that may be disposed in offset circumferential rows around the concave bowl 110. In some embodiments the rows may align with each other. The super hard composite inserts 205 may be incorporated in a replaceable wear liner 115, and may extend from one crushing surface 120 towards another opposing crushing surface 120. The inserts 205 may be disposed in such a way to provide optimal disintegration of crushing material while also providing enhanced wear resistance for the replaceable wear liner 115. The super hard composite inserts 205 may be brazed, press fit, or otherwise bonded into the crushing surface 120. The super hard composite inserts 205 may protrude out of the crushing surface 120 at a range of between 0.100 to 3.00 inches depending on the material to be reduced. In some embodiments the super hard composite inserts 205 do not protrude at all from the crushing surface 120 but are flush or retracted within the surface 120. In other embodiments the super hard composite inserts 205 are simply bonded to a flat surface of the crushing surface 120.

A diameter of the super hard composite inserts 205 may range from 3 mm to 19 mm.

The inserts 205 may comprise a solid material or a combination of materials.

Preferably the inserts comprise a base segment formed of cemented metal carbide substrate with a super hard material bonded to it forming a tip. The tip may comprise a coating of super hard material. The super hard material may be selected from the group consisting of diamond, polycrystalline diamond, cubic boron nitride, refractory metal bonded diamond, silicon bonded diamond, cobalt bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, and combinations thereof. The hardness of the surfaces of super hard materials, in some cases, may be adjusted by doping or infiltrating materials with higher or lower concentrations of metals and/or hard materials until a desired hardness is achieved. The super hard material may be bonded to the substrate with a non-planar interface to increase the strength of the bond. Also the super hard material may be a sintered body, such as in embodiments where a polycrystalline diamond is used, and may be made thermally stable by removing a thin layer of metal binders (which may have a higher coefficient of thermal expansion than the grains of the super hard material) in the surface by leaching. The super hard material may comprise a metal binder concentration less than 40 weight percent. In embodiments, where polycrystalline diamond is used a higher concentration of cobalt typically reduces the brittleness of the polycrystalline diamond but as a tradeoff may increase its susceptibility to wear. In other embodiments the polycrystalline diamond may comprise at least a portion which is produced by high pressure high temperature method without a metal catalyst. Various insert geometries may be used. Each geometry may be advantageous depending on the material and application of the replaceable wear liner. These inserts may be bonded or otherwise attached to any portion of the replaceable wear liner, although they are preferably attached to at least the lower portion of the replaceable wear liner where it is most prone to wear.

Figure 3:
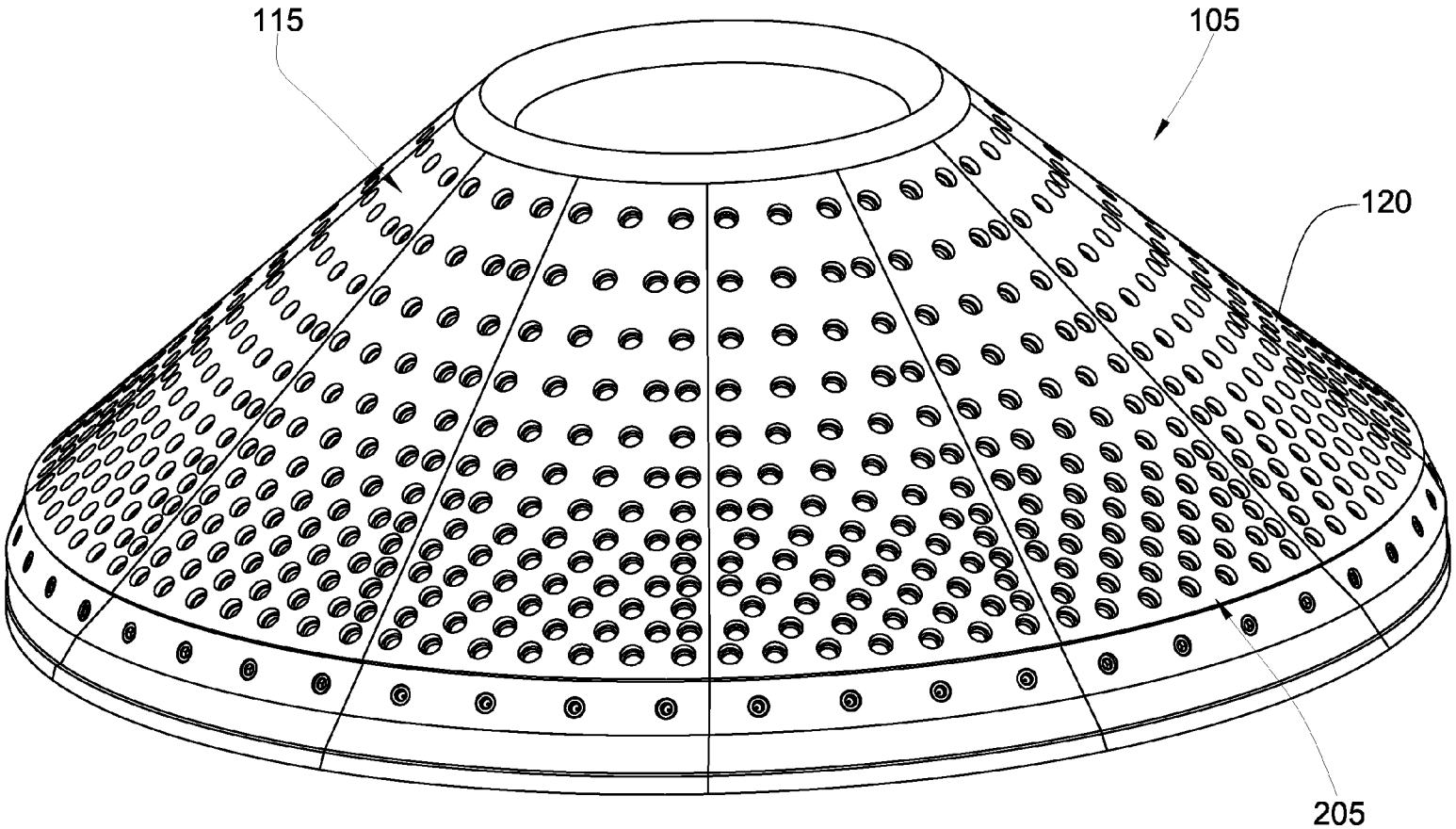
FIG. 3 is a perspective diagram of another embodiment of a replaceable segmented wear liner.

Referring now to FIG. 3, an embodiment of a segmented wear liner 115 is disposed on a crushing surface 120 of a conical head 105. The diagram discloses that super hard composite inserts 205 may be disposed in aligned circumferential rows around the conical head 105. In some embodiments, inserts 205 may be disposed in concentrically circumferential rows on both the conical head 105 and concave bowl 110. The circumferential rows of inserts 205 may be closer together at the bottom of the cone 105 and/or bowl 110 than at the top. In other embodiments it may be advantageous to have the super hard composite inserts 205 disposed only in the lower portions of the conical head 105 and/or the concave bowl 110 in various arrangements.

The replaceable wear liner 115 may cover the entire surface area of the conical head 105 and/or the concave bowl 110. In some embodiments, only areas susceptible to high wear are lined.

Figure 4:
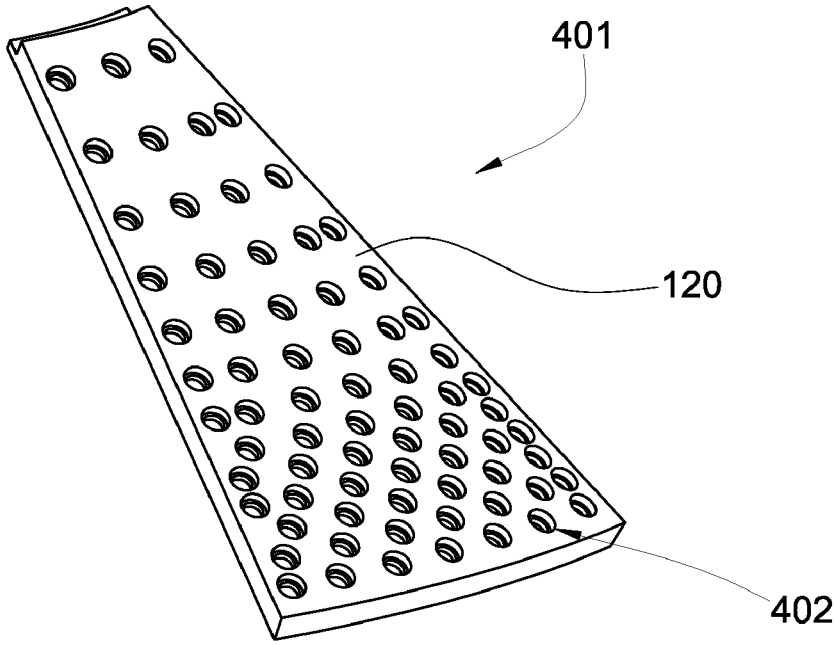
FIG. 4 is a perspective diagram of an embodiment of replaceable segment of a segmented wear liner.

FIG. 4 discloses an embodiment of a replaceable segment 401 of a wear liner 115.

In this embodiment the wear liner 115 is vertically segmented to form pie shaped segments 401. The crushing surface 120 of the segment 401 may comprise recesses 402. The recesses 402 may be preformed in the segment 401 or they may be machined into the segment 401. The recesses 402 may comprise a geometry compatible to receive super hard composite inserts 205, or inserts 205 surrounded by a wear resistant washer.

Figure 5:
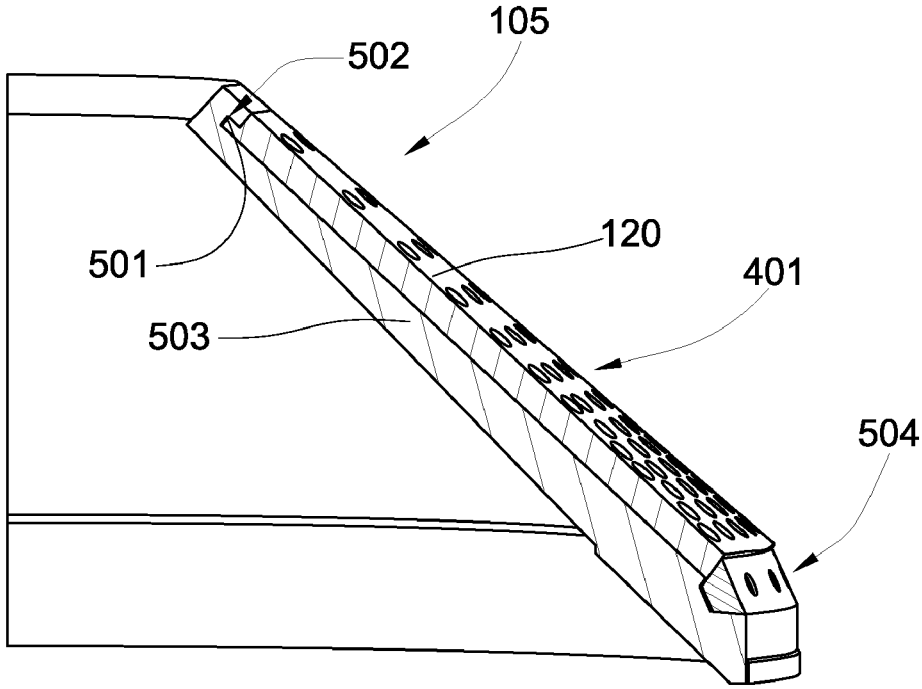
FIG. 5 is a cross-sectional diagram of an embodiment of a replaceable segmented wear liner.

Referring now to FIG. 5, a segment 401 may interlock with the head 105.

Although the segment 401 is shown interlocking with the head 105, a segment 401 may interlock with the head 105 or with the bowl 110. Some embodiments of a segment 401 may comprise a tenon or protruding member 501. The protruding member may run along the entire length of the top of the segment 401, or it may run along only a portion of the length of the top of the segment 401. The protruding member 501 may be complementary to a cavity or mortise 502 formed in a backing plate 503 of the head 105 or the bowl 110. Furthermore, a wedge 504 may be fastened to the backing plate 503 of the head 105 or the bowl 110, such that the wedge holds the segment 401 in compression and pushes upwards. It is believed that the combination of the upwards force and the positioning of the protruding member 501 inside the mortise 502 in the backing plate 503 may result in axial compression thereby holding the segment 401 in place without the use of fasteners on the crushing surface 120. Because of the highly abrasive forces experienced on the crushing surface 120, it is believed that fasteners on the crushing surface are vulnerable to wear. In addition, the use of a wedge to hold the segments in compression allows for easy replacement by simply unfastening the wedge and eliminating the compression.

Figure 6:
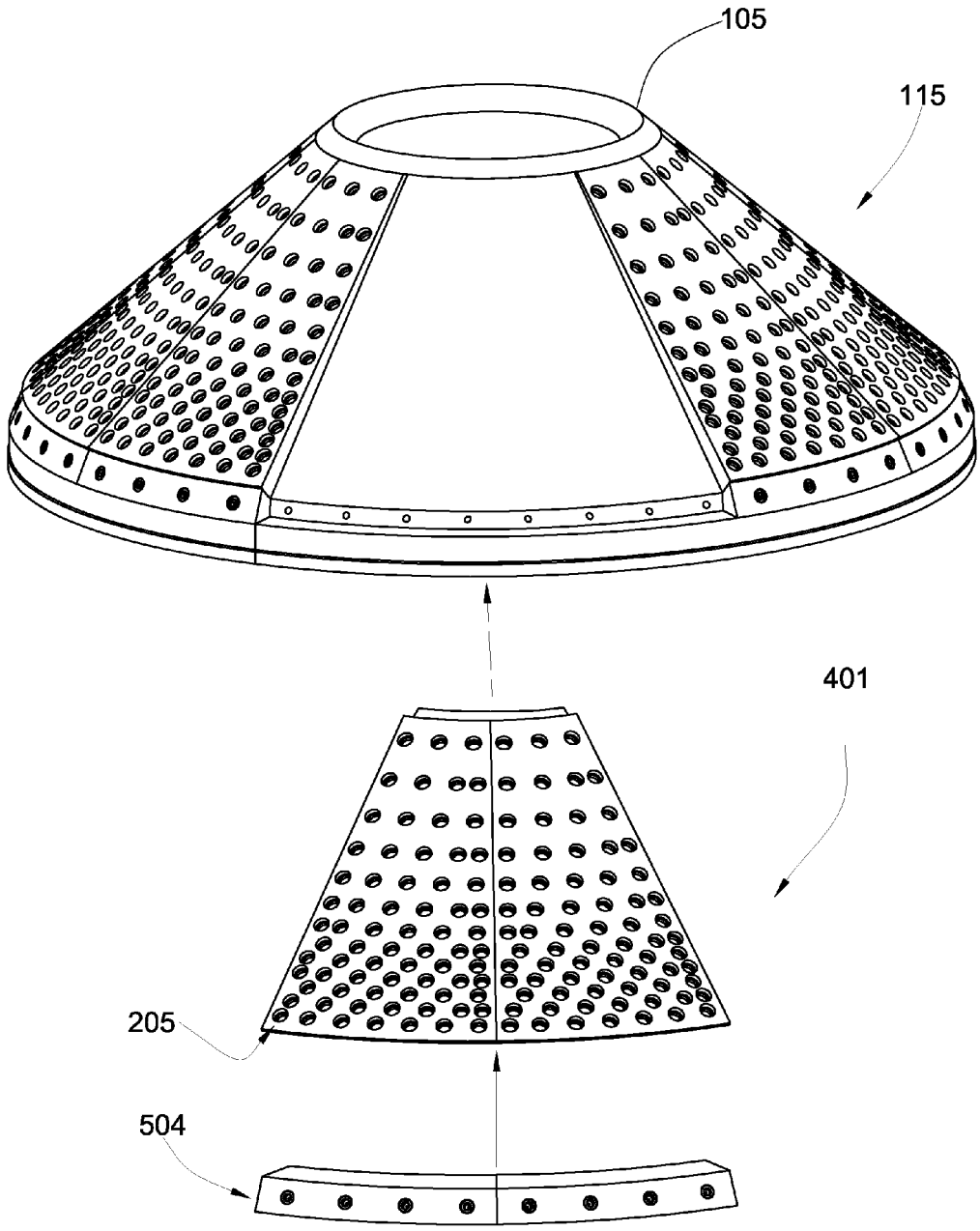
FIG. 6 is an exploded view of an embodiment a replaceable segmented wear liner.

FIG. 6 discloses an exploded view of a replaceable segmented wear liner 115.

Though the diagram discloses the wear liner 115 disposed on a conical head 105, the wear liner 115 may be disposed on the bowl 110. In one aspect of the invention, the replaceable segmented wear liner 115 allows even one damaged or defective segment 401 to be replaced without replacing the rest of the liner 115. One piece of wedge 504 may be unfastened from the apparatus, allowing the defective segment 401 to be slid down and out of the liner 115. In some cases where a particular insert 205 or region of the segment 401 is particularly worn or damaged, the segment 401 may be replaced while the defective or damaged region is being repaired. The ease of replacing segments 401 independently of each other is believed to reduce the amount of replacement parts, and to significantly reduce the down time of the machine. This is believed to result in a decrease in operation costs.

Figure 7:
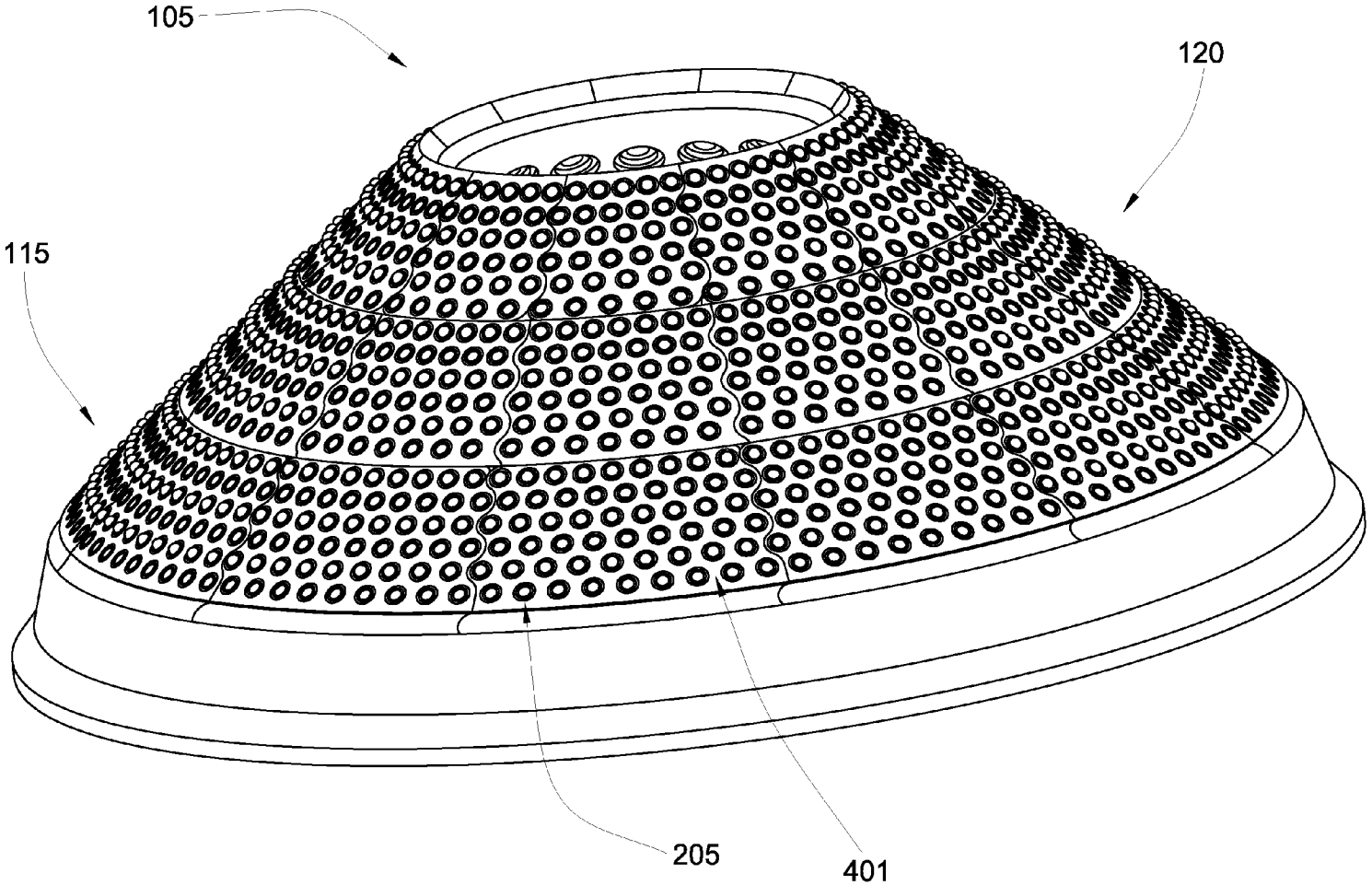
FIG. 7 is a perspective diagram of another embodiment of a replaceable segmented wear liner.

Referring now to FIG. 7, a conical head 105 comprises a replaceable wear liner 115 that is segmented both vertically and horizontally. It is believed that a wear liner 115 that is segmented both horizontally and vertically allows for replacement of even smaller segments 401 than a liner 115 that is only vertically segmented. Because the space between crushing surfaces 120 is smallest near the bottom of the head 105 and the bowl 110, it is believed that the crushing surfaces 120 experience the greatest wear near the bottom. Segments 401 near the bottom may necessitate more frequent replacement. Additionally, some applications of the invention may favor specific insert placements patterns and densities at specific circumferences of the crushing surface 120. These placement patterns and densities may be more readily available in a horizontally and vertically segmented liner 115. Although FIG. 7 depicts alternating circumferential rows of inserts 205 from the top of the head 105 to the bottom, other insert placement patterns and densities may be used.

Figure 8:
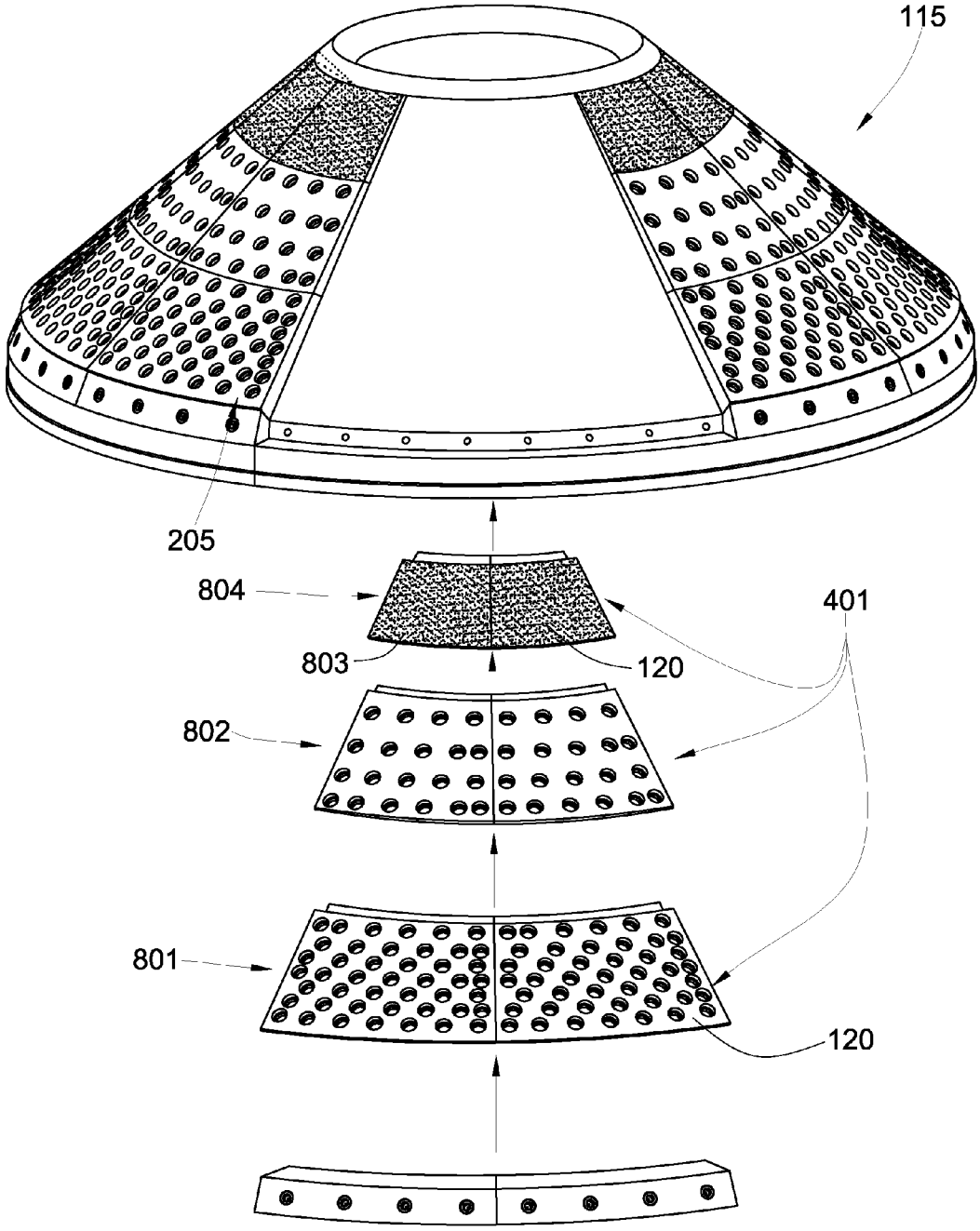
FIG. 8 is an exploded view of another embodiment of a replaceable segmented wear liner.

FIG. 8 discloses an exploded view of another embodiment of a horizontally and vertically segmented wear liner 115. This embodiment illustrates choices of different insert placement patterns and densities for different segments 401. A bottom segment 801 may comprise a high density of inserts 205 disposed on the crushing surface 120.

A middle segment 802 may comprise an insert density smaller than that on the bottom segment 801. In some applications, segments 401 may not comprise inserts 205.

Instead, segments 401 may comprise a hard surface 803 comprising tungsten carbide, niobium carbide, a cemented metal carbide, hard metal, chromium, aluminum, nitride, titanium manganese carbide, or combinations thereof This may be advantageous in applications where a less costly means of wear resistance and crushed material geometry control in required. The hard surface 803 may serve to enhance resistance to wear and may assist to prolong the life of the replaceable wear liner 115 in combination with the super hard composite inserts 205. The thickness of the hard surface 803 may range from 0.100 to 2.00 inches. FIG. 8 discloses a top segment 804 that does not comprise inserts 205 and where the entire crushing surface 120 of the top segment 804 comprises a hard surface 803. Although insert 205 densities and hard surface 803 placements have been shown on individual vertical segments 401, any combination of insert densities, insert placement patterns, and hard surface placement patterns may be used on any segment 401.

Figure 9:
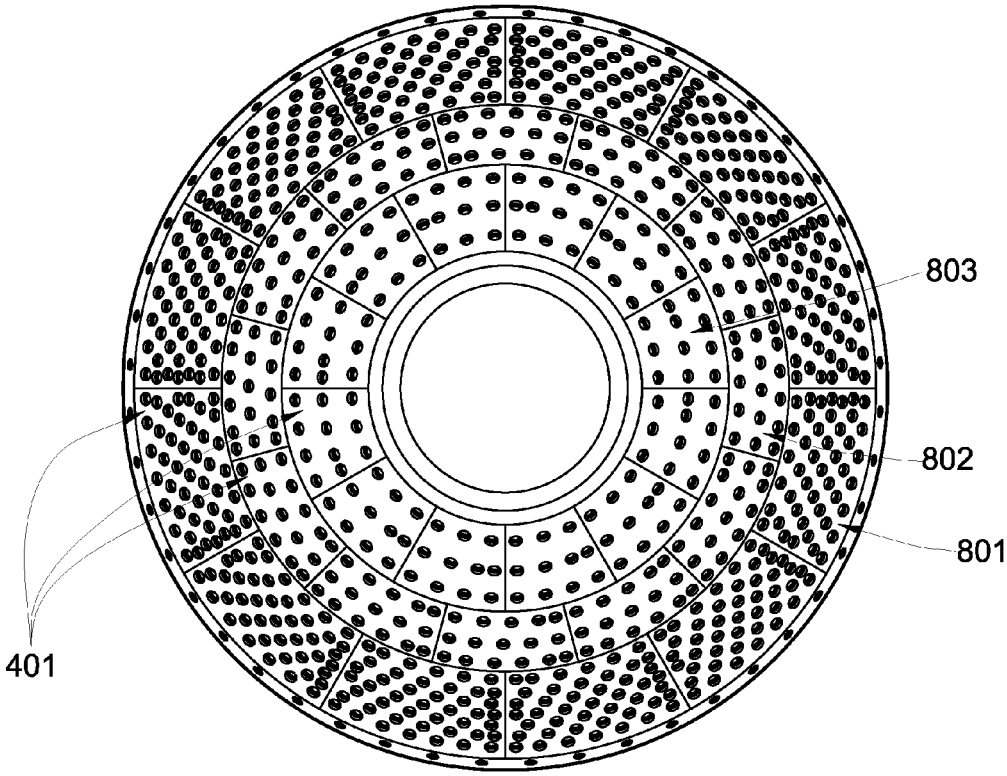
FIG. 9 is a top-view diagram of another embodiment of a replaceable segmented wear liner.

Referring now to FIG. 9, in some applications of the wear resistant liner 115 it may be advantageous for segments 401 immediately vertically adjacent to one another to be offset. In some applications the wear on the bottom segments 801 may be so much greater than the middle and top segments 802, 804, that replacement of the bottom segments 801 occurs much more frequently than replacement of the middle or top segments 802, 804. In such applications offseting the bottom segments 801 with the middle segments 802 may allow for replacement of one bottom segment 801 without removing the compressive force holding the middle and top segments 802, 804 in place. Although in this embodiment each level of segments is offset with the immediately vertically adjacent level, any combination of alignment and/or misalignment may be used.

Figure 10:
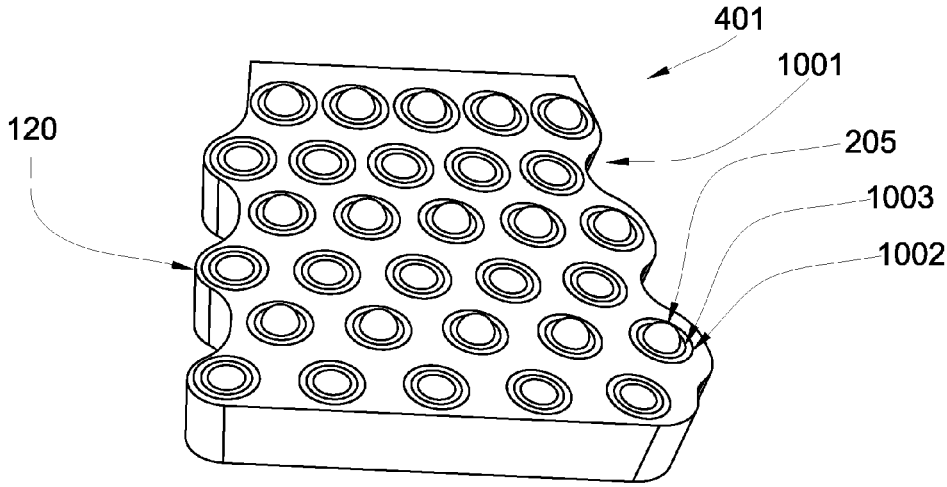
FIG. 10 is a perspective diagram of another embodiment of a segment of a replaceable wear liner.

Referring now to FIG. 10, an embodiment of a segment 401 of a replaceable wear liner is disclosed in which some edges 1001 of the segment 401 are non-planar. In applications where offset rows of inserts 205 are preferable, non-planar edges 1001 may allow for insert 205 placements nearer to the edge 1001 than a flat, planar edge 1001. Although a specific non-planar edge 1001 geometry is depicted, any non-planar or planar edge 1001 geometry may be used. Furthermore, FIG. 10 discloses a plurality of inserts 205 that comprise a circumscribing wear resistant washer 1002 that is separated from the insert 205 by a material 1003 that is softer than both the insert 205 and the washer 1002. The presence of a softer intermediate material 1003 is believed to mediate the pressure of press fitting a hard insert 205 into another hard material, such as a wear resistant washer 1002. In some embodiments the washer 1002 may not be separated from the insert 205 by a softer material 1003. The washer 1002 is believed to offer a greater amount of wear resistance to the crushing surface 120 immediately surrounding the insert 205. Because the insert 205 is typically much harder than the crushing surface 120, the region immediately surrounding the insert 205 may wear much before the insert 205 itself wears. This may cause the insert 205 to fall out. Protecting the region immediately surrounding the insert 205 with a washer 1002, or some other wear resistant device, may prolong the life of the insert, and thereby the wear liner.

Figure 11:
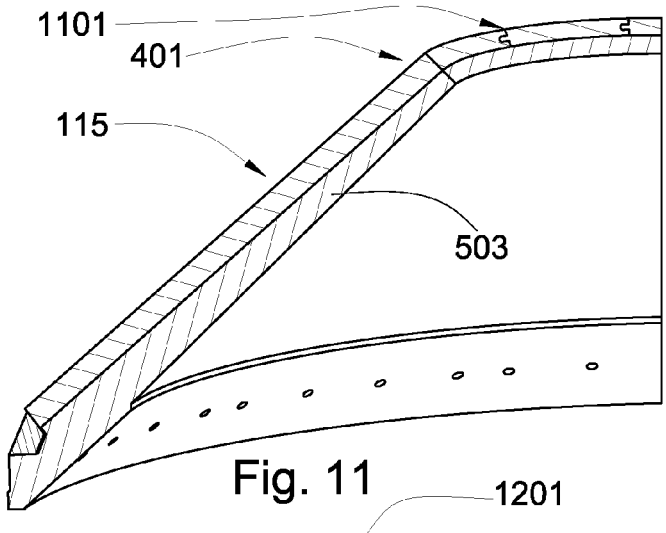
FIG. 11 is a perspective diagram of an embodiment of interlocking segments of a replaceable wear liner.
Figure 12:
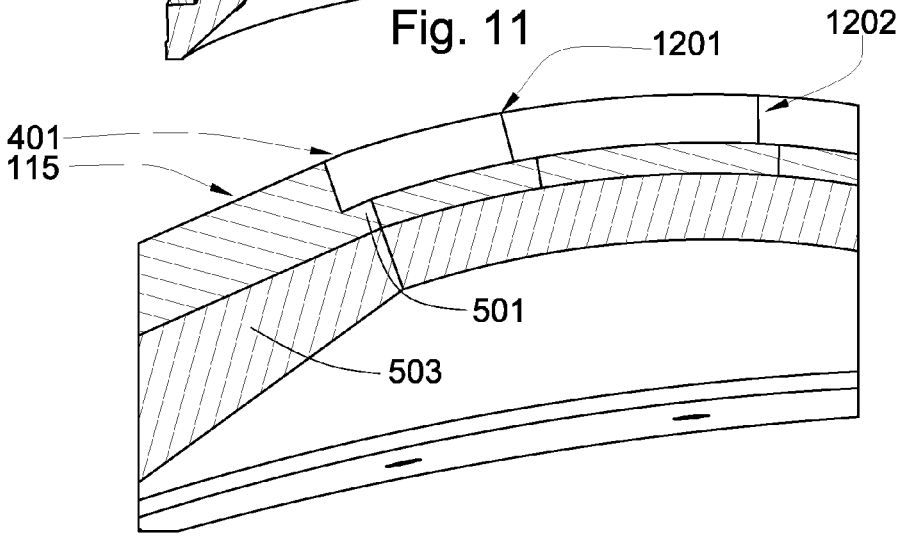
FIG. 12 is a perspective diagram of another embodiment of interlocking segments of a replaceable wear liner.
Figure 13:
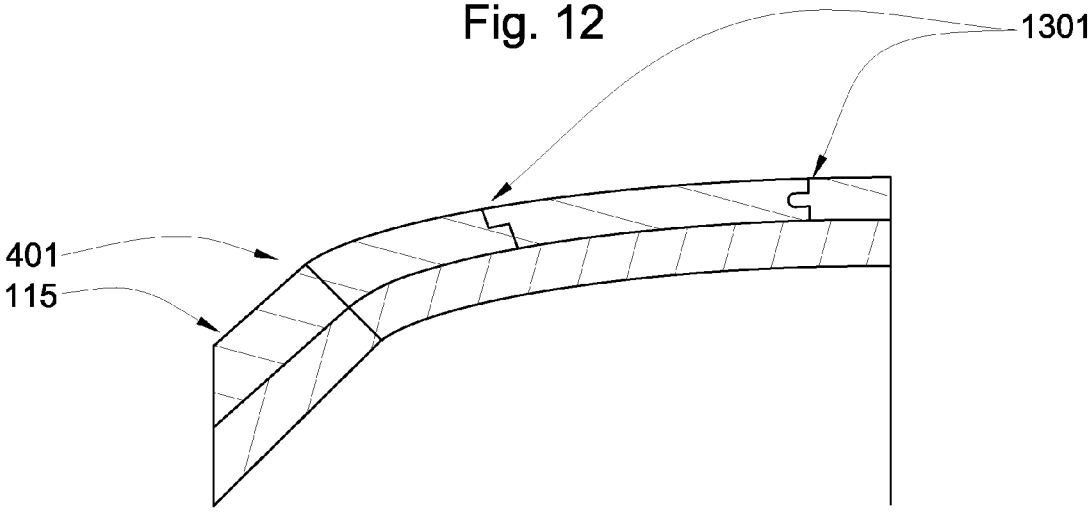
FIG. 13 is a perspective diagram of another embodiment of interlocking segments of a replaceable wear liner.

FIGS. 11-13 disclose embodiments of the invention in which segments 401 of the wear liner 115 interlock with one another. FIG. 11 discloses an embodiment of a wear liner 115 in which segments 401 interlock with one another using a tongue and groove joint 1101. A tongue and groove joint 1101 may be favorable in applications where vibration has a tendency to move the segments 401 away from the backing plate 503 of the head 105 or the bowl 110. FIG. 12 discloses an embodiment of a wear liner 115 in which segments 401 interlock with one another using a lap-joint 1201. The large, polygonal sides 1202 of the lap-joint 1201 may have an advantage in resisting breakage due to forces caused by the abrasive nature of rock crushing. As disclosed in FIG. 12, the segments 401 may interlock both with other segments 401 and with the backing plate 503 of the head 105 or of the bowl 110. The combination a protruding member 501 interlocking with the backing plate 503 while the segments 401 interlock with one another may increase the stability of the whole segmented wear liner 115. FIG. 13 discloses an embodiment of a wear liner 115 in which segments 401 interlock with one another using a combination of joints 1301. Although specific joints have been depicted in specific combinations with other aspects of the invention the segments 401 may interlock with one another using a joint from the group consisting of tongue and groove joint, mortise and tenon joint, lap-joint, dovetail joint, or combinations thereof, in combination with any other aspect of the invention. Other interlocking joints may also be encompassed by the present invention.

Figure 14:
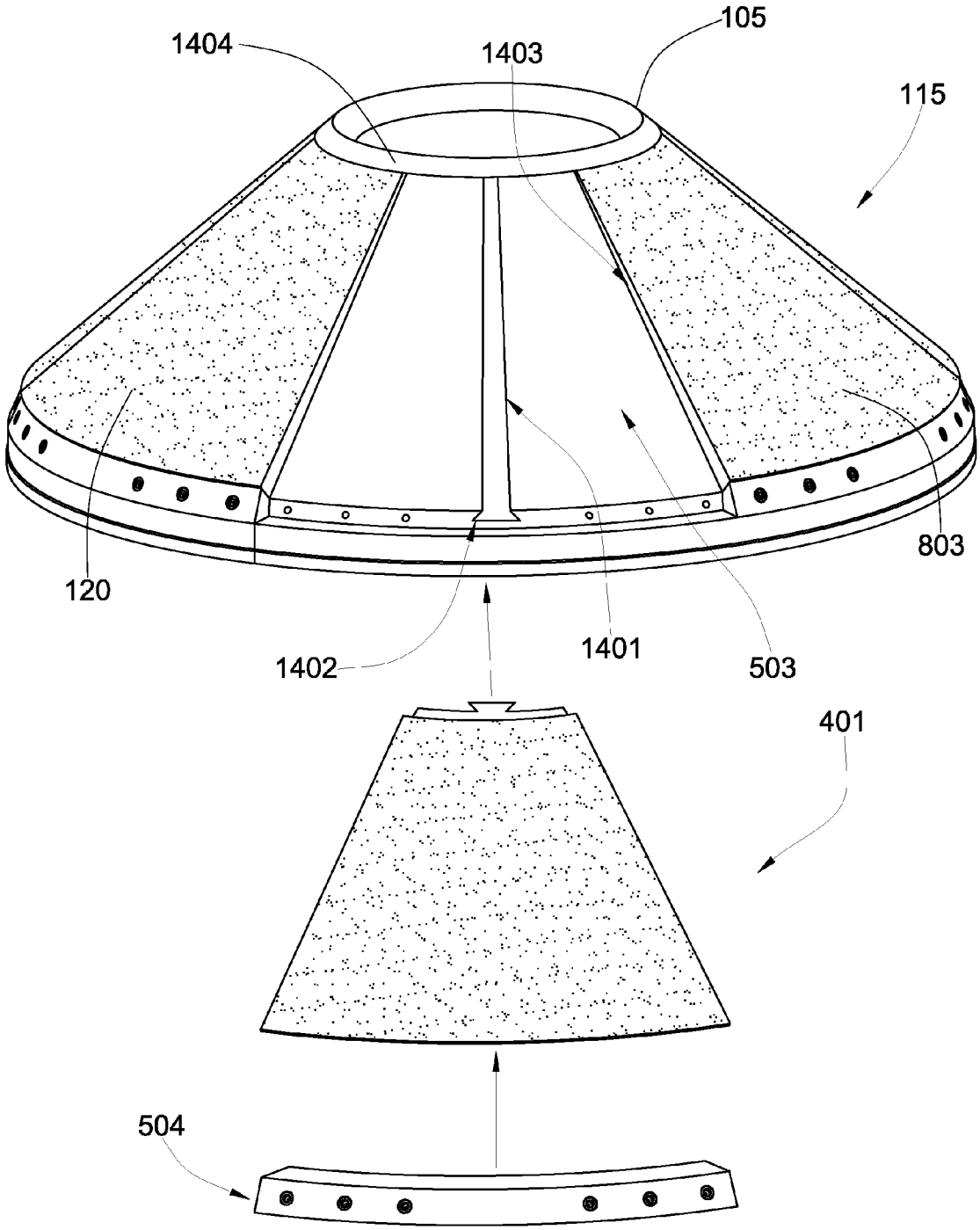
FIG. 14 is a perspective diagram of another embodiment of a replaceable segmented wear liner.

Referring now to FIG. 14, an embodiment of a segmented wear liner 115 is disclosed in which the segments 401 of the wear liner 115 interlock with the head 105 by a guide track 1401 disposed in the backing plate 503 of the head 105. Although a single guide track 1401 is shown on the head 105, one or a plurality of guide tracks 1401 may be disposed on the head 105 and/or on the bowl 110. Although FIG. 14 discloses a track comprising a dovetail shape 1402, tracks 1401 may comprise a T-shape, an L-shape, or any other geometry. Also disclosed in FIG. 14 is an embodiment of the invention without inserts 205. The segments may comprise only a body 1403 or they may comprise a hard surface 803 on part or on the entire crushing surface 120.

Exposed surfaces 1404 of the backing plate 503 of the head 105 or of the bowl 110 may comprise a hard surface 803. Although specific portions of the wear liner 115 have been shown with specific arrangements of inserts 205 and hard surfaces 803, any component of the cone crusher 100 that experiences wear due to the abrasive nature of rock crushing may comprise hard surfaces 803 and/or inserts 205.

Figure 15:
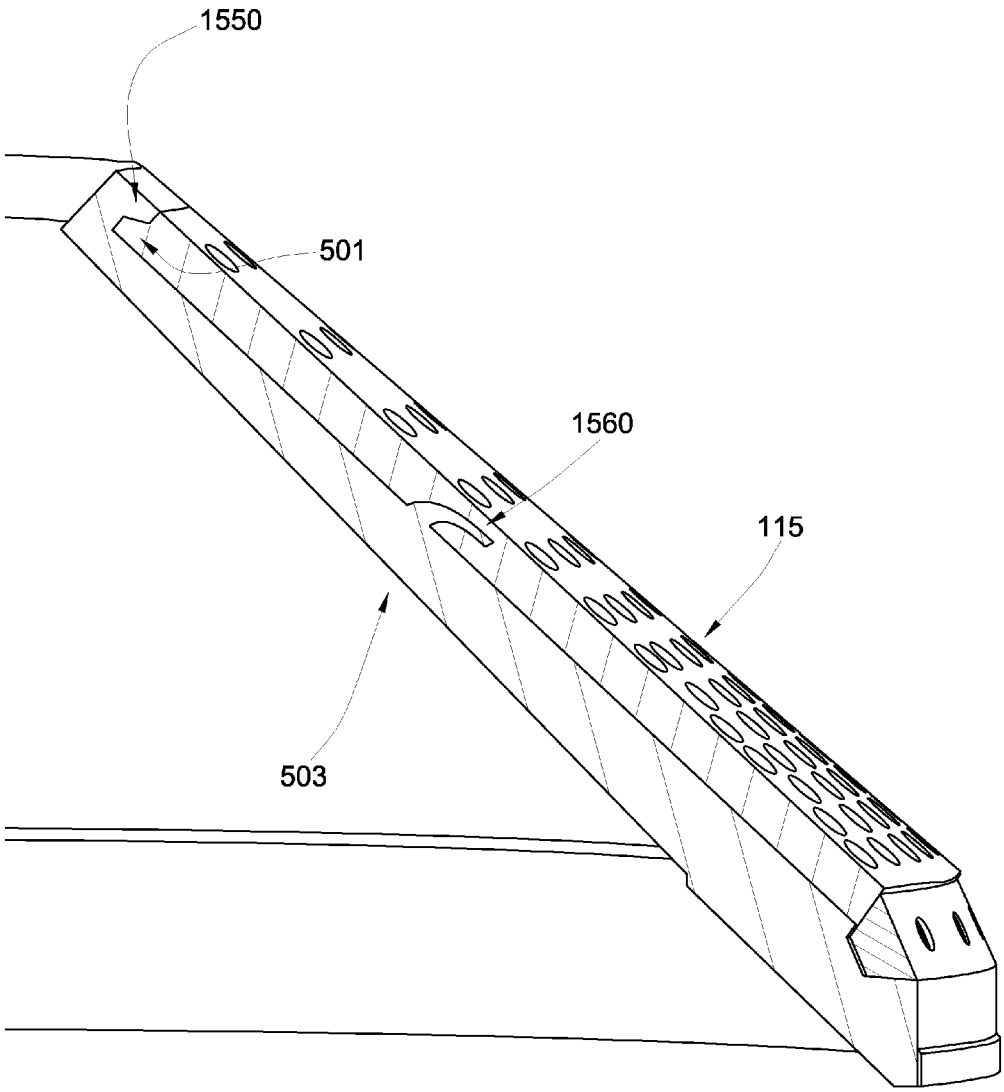
FIG. 15 is a cross-sectional diagram of another embodiment of a replaceable segmented wear liner

Referring now to FIG. 15, an embodiment of a wear resistant liner 115 is shown in which the protruding member 501 has a tapered front edge 1550. It is believed that tapering the front edge 1550 of the protruding member 501 may reduce movement and friction due to vibration. Because the protruding member may be the thinnest part of the wear liner 115, it may be the part most vulnerable to breakage due to movement and friction. It is believed that the tapered front edge 1550 may reduce the likelihood of breakage at or near the protruding member 501. FIG. 15 also discloses a hook 1560 that protrudes from the backing plate 503 and fills a cavity in the wear liner 115. In applications where extreme vibrations or buckling tends to occur in the wear liner the hook 1560 is believed to help maintain the wear liner 115 in compression. Although the present embodiment depicts the tapered front edge 1550 and the hook 1560 with specific geometries and locations adapted for use with the head 105, it may be used with the bowl 110, and with any geometry or location. Additionally, multiple hooks 1560 may be used.

Figure 16:
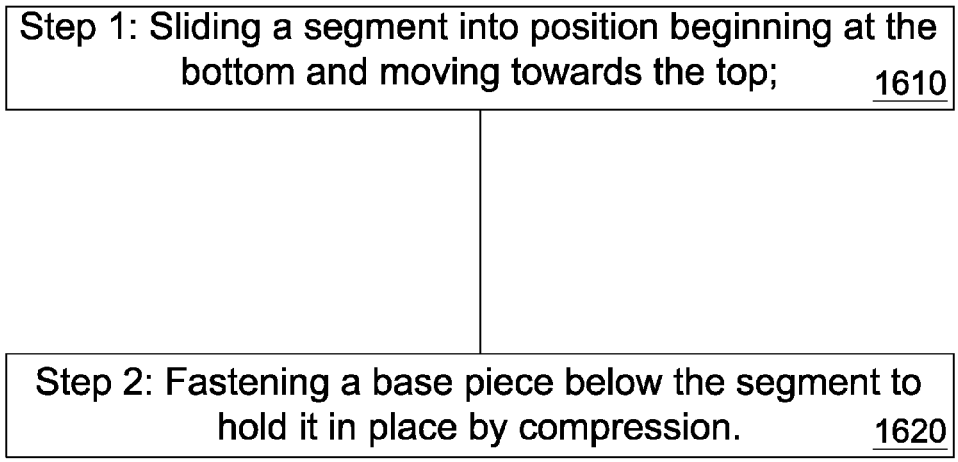
FIG. 16 is a diagram of a method for assembling a replaceable segmented wear liner.

Referring now to FIG. 16, a method of assembling a replaceable segmented wear liner is shown. In the first step 1610, a segment is slid into position beginning at the bottom of the head or of the bowl and moving towards the top. In applications where segments interlock with either each other or with the bowl or the head, the joints must be aligned before the segment can be slid upwards. In embodiments where multiple segments must be placed vertically adjacent one another, the lower segments must be positioned after the higher segments, as described in the first step 1610. In the second step 1620, a base piece is fastened below the segment or segments to hold them together in compression. As previously discussed, a wedge shaped base piece may aid in compressing the segment or segments. This method of assembling a replaceable liner may allow easier and faster replacement of specific segments of the wear liner, without disturbing horizontally adjacent segments. Some prior art may describe attachment methods that rely on a force directed towards the cone crusher in order to hold the liner in place, such as the force of impacting material. The present method may be counterintuitive as it uses a compression force that may be directed away from the cone crusher to hold the liner in place on the cone crusher.

Whereas the present invention has been described in particular relation to the drawings attached hereto, it should be understood that other and further modifications apart from those shown or suggested herein, may be made within the scope and spirit of the present invention.

What is claimed is:

1. A cone crusher, comprising:

a crushing surface comprising a conical head and a concave bowl;

at least one of the head or bowl comprising a segmented wear liner;

at least one insert is disposed within the liner and a circumscribing wear resistant washer is disposed around the at least one insert; and the at least one insert is press fit into a material softer than the washer and at least one insert; the softer material being disposed between the at least one insert and the washer;

wherein at least one segment of the wear liner is held in place by compression.

2. The cone crusher of claim 1, wherein a body of the wear liner comprises manganese, steel, stainless steel, carbide, tungsten carbide, hard metal, chromium, aluminum, nitride, titanium, or combinations thereof.

3. The cone crusher of claim 1, wherein the wear liner comprises a hard surface of a material selected from the group consisting of tungsten carbide, niobium carbide, a cemented metal carbide, hard metal, chromium, aluminum, nitride, titanium manganese carbide, or combinations thereof.

4. The cone crusher of claim 1, wherein adjacent segments of the wear liner interlock with one another.

5. The cone crusher of claim 1, wherein at least one segment of the wear liner interlocks with at least one of the head or the bowl.

6. The cone crusher of claim 1, wherein at least one segment of the wear liner is held in place by lateral compression.

7. The cone crusher of claim 1, wherein the at least one segment of the wear liner is held in place by axial compression.

8. The cone crusher of claim 1, wherein a junction between adjacent segments is non-planar.

9. The cone crusher of claim 1, wherein the bowl and/or the cone comprise at least one guide track.

10. The cone crusher of claim 1, wherein the wear liner is horizontally and/or vertically segmented.

11. The cone crusher of claim 1, wherein segments of the liner are adapted to wedge together.

12. The cone crusher of claim 1, wherein a at least two vertically adjacent segments are offset.

13. The cone crusher of claim 1, wherein the wear liner comprises a plurality of wear resistant inserts.

14. The inserts of claim 13, wherein at least one wear resistant insert comprises a coating selected from the group consisting of diamond, polycrystalline diamond, cubic boron nitride, refractory metal bonded diamond, silicon bonded diamond, cobalt bonded diamond, layered diamond, infiltrated diamond, thermally stable diamond, natural diamond, vapor deposited diamond, physically deposited diamond, diamond impregnated matrix, diamond impregnated carbide, cemented metal carbide, carbide matrix, chromium, titanium, aluminum, tungsten, and combinations thereof.

15. The inserts of claim 13, wherein the inserts are brazed or press fit into cavities in the crushing surface.

16. The inserts of claim 13, wherein the inserts protrude beyond the crushing surface by 0.010 to 3.00 inches.

17. The cone crusher of claim 1, wherein the interlocking segments, and/or at least one segment and at least one of the cone or the bowl, form a joint from the group consisting of tongue and groove joint, mortise and tenon joint, lap-joint, dovetail joint, or combinations thereof.

* * * * *